US005551367A

United States Patent [19]

Vitkauskas

[11] Patent Number: 5,551,367

[45] Date of Patent: Sep. 3, 1996

[54] DUAL SETTING UNDER PRESSURE RELIEF SYSTEM

[75] Inventor: John D. Vitkauskas, Novato, Calif.

[73] Assignee: Chevron U.S.A. Inc., San Francisco, Calif.

[21] Appl. No.: 412,639

[22] Filed: Mar. 29, 1995

Related U.S. Application Data

[63] Continuation-in-part of Ser. No. 156,215, Nov. 22, 1993, abandoned, which is a continuation-in-part of Ser. No. 842,841, Feb. 26, 1992, abandoned.

[51] Int. Cl.[6] ..... B63B 25/08

[52] U.S. Cl. ..... 114/74 R; 137/68.11

[58] Field of Search ..... 114/74 R, 74 T, 114/21.1, 72; 137/68.1, 68.2, 43, 493.7, 49.8, 493, 493.9; 220/204; 251/306

[56] References Cited

U.S. PATENT DOCUMENTS 3,839,982 10/1974 Martin et al. ..... 114/74 R
4,067,352 1/1978 Halpine ..... 137/312
4,508,131 4/1985 DeFrees ..... 137/43
5,285,745 2/1994 Husain ..... 114/74 R

*Primary Examiner*—Stephen Avila
*Attorney, Agent, or Firm*—M. W. Carson

[57] ABSTRACT

A system for providing differential pressure relief in vessels having a cargo tank, incorporating an inert gas biased pressure/vacuum relief valve is disclosed. A source of inert gas, under controlled pressure and flow rate is connected to a vacuum outlet of a pressure/vacuum valve to bias the valve so that a desired pressure differential across the tank can be maintained during normal operations and easily changed and so that the valve will open at two different desired pressure differentials. A rupture disk connected to the vacuum pump adaptor is set to rupture at a desired pressure differential across the disk to allow atmospheric pressure to reach the vacuum outlet in the event of a rupture. A vacuum pump replaces the rupture disk to maintain a desired pressure differential across the pressure/vacuum valve, so as to reduce the amount of cargo that would leak from the damaged tank.

5 Claims, 10 Drawing Sheets

DUAL SETTING UNDER PRESSURE RELIEF SYSTEM

RELATED APPLICATION

This application is a Continuation-In-Part of U.S. Ser. No. 08/156,215, filed Nov. 22, 1993, now abandoned which, in turn is a Continuation-in-Part of U.S. Ser. No. 07/842,841 filed on Feb. 26, 1992 now abandoned.

FIELD OF THE INVENTION

This invention relates generally to maintaining the proper pressure differential between a closed cargo tank and the atmosphere. More specifically, the present invention is directed to a pressure/vacuum valve system which automatically regulates the pressure differential when a cargo leak occurs. In addition, a novel method of removing cargo which is at risk to leak is disclosed.

BACKGROUND OF THE INVENTION

The storage of fluids in closed cargo tank containers requires pressure relief to allow for changes in pressures in the tanks as the fluids contract and expand through diurnal heating and cooling. Pressure compensation by venting has been especially utilized. Existing differential pressure valves, such as pressure/vacuum relief valves discharge to or suck from a back pressure equal to atmospheric pressure when cargo tank pressure either exceeds or is lower than an acceptable limit. However, as such pressure/vacuum valves typically are set to open at a relatively slight negative pressure differential, so that when a tank ruptures, initial outflow of the cargo will cause the pressure/vacuum valve to open, permitting additional uncontrolled out-flow to occur, as tank pressure is allowed to stabilize with the atmosphere. Manual re-setting of the pressure/vacuum valves during normal operations would be difficult, and would present a safety hazard as an undue lower pressure in the tank could cause the tank to collapse in.

U.S. Pat. No. 4,508,131, issued to DeFrees discloses a valve system for cargo tanks which provides differential pressure relief. A pressure/vacuum valve has a spring bias, requiring manual adjustment to set the valve to a desired required differential pressure to open the valve. There is no discussion of any method or system to bias the pressure/vacuum valve setting to alter the differential pressure requirement between the atmosphere and the tank, necessary to open the valve once the pressure/vacuum set point is established.

U.S. Pat. No. 4,067,352, issued to Causey discloses a pressure/vacuum valve which is designed to maintain a near constant pressure or vacuum in a ship's cargo tank and to provide differential pressure relief. However, this patent requires a system of inert pressurizing gas lines and valves to restore pressure in the cargo tank which was lost through venting to or from the atmosphere. There is no discussion of biasing the pressure/vacuum valve setting to alter the differential pressure requirement between the atmosphere and the tank, necessary to open the valve, after the pressure/vacuum valve set point is established.

U.S. Pat. No. 3,839,982, issued to Martin et al., discloses a vacuum relief valve system designed to open automatically when tank pressure falls slightly below that of the atmospheric pressure. A valve operature restricts air-flow to a velocity below 200 ft/sec. Again, there is no mention of biasing the valve setting to modify the differential pressure at which the valve will open.

Additional prior work includes two (2) related publications by M. Husain: "Advanced Spill Avoidance System For Oil Tankers By Inert Gas Controlled Method Utilizing Vacuum Technique", presented Sep. 28, 1990 to the Marine Technology Society, in Washington D.C., and "Advanced Spill Avoidance System For Unmanned Barges", presented at the Marine Technology Society Conference on Nov. 13, 1991, in New Orleans, La. Both publications disclose a method of modifying existing inert gas pressure maintenance systems to provide underpressure in the cargo tank ullage space, to prevent oil spillage above the rupture line in the case of a tank rupture. A computerized system of inert gas conduits and valves monitors tank pressure levels and initiates a response to equalize the pressures that are inside and outside of a selected cargo tank, to maintain a slight underpressure in the ullage above the cargo. As pressure equalization at a rupture point is attained, a reduction in further oil spillage occurs. Such a system of computerized valves and inert gas conduits is costly, complicated, and requires significant maintenance.

The prior work is limited in the attempts at providing differential pressure relief to a cargo tank that has been ruptured. None of the prior work teaches a system of adding a bias to a pressure/vacuum valve to alter the required differential pressure to open the valve, once the valve has been set. There is therefore a need for such an inexpensive, non-complex system with very few working parts, requiring no manual re-setting of the pressure/vacuum valves and no welding, and which is easily verifiable by local port authorities.

SUMMARY OF THE INVENTION

The present invention is surprisingly successful in providing a differential pressure relief system for use in vessels such as ships having at least one closed cargo tank with a hatch and a vent conduit leading to the atmosphere. A pressure/vacuum valve is connected to the atmospheric end of the vent conduit, and has a pressure discharge outlet, a separate vacuum outlet, and valve seats.

A vacuum pump adaptor having an adaptor conduit is connected to the pressure/vacuum valve vacuum outlet, and a vacuum pump is connectable to the vacuum pump adaptor so that a first desired pressure differential through the adaptor conduit and across the tank can be maintained. A source of inert gas having an inert gas bias conduit connects the source to the vacuum pump adaptor to provide a pressure bias to the vacuum outlet so that the valve will open at a second desired pressure differential between the tank and the atmosphere. In another embodiment, a spectacle blind flange is positioned between the pump adaptor and the inert gas bias conduit to selectively isolate the vacuum pump adaptor outlet from the gas bias conduit.

The inert gas is flowed from the source to the vacuum outlet at a desired pressure with the flow rate limited by an orifice. A rupture disk is disconnectably connected to the vacuum pump adaptor to seal off the adaptor conduit, such that the disk will rupture at a third desired pressure differential across the disk, to allow atmospheric pressure to reach the vacuum outlet. The rupture disk is then removed and the vacuum pump is substituted therefor, so that said first desired pressure differential can be maintained across cargo tank boundaries.

In another embodiment of the present invention, a first pump discharge conduit permits removal of a desired volume of the cargo, while maintaining the existing pressure differential between the tank and the atmosphere. A lower end of the first discharge conduit disconnectably connects to a pump, and an upper end has a puncturable diaphragm having a small hole therein. A hatch is adaptable to permit the first pump discharge conduit to slide therethrough into the tank to a selected level.

In another embodiment of the invention, the hatch is a modified Butterworth plate having a ball valve and one or more o-ring seals.

In yet another embodiment, the upper end of the pump discharge conduit has internal threads which mate with the external threads at the bottom end of a second pump discharge conduit. The bottom end punctures the diaphragm upon connection to the first discharge conduit. The top end has a set of internal threads and a second diaphragm, so that the second discharge conduit connects to the first discharge conduit to permit an increased amount of cargo to be removed. A means is provided for supporting the first discharge conduit in its lowered position.

The above and other embodiments, objects, advantages, and features of the method of the invention will become more readily apparent from the following detailed description of the invention, which is provided in connection with he accompanying drawings.

DETAILED DESCRIPTION OF THE INVENTION

In accordance with the present invention, a new improved differential pressure relief system for use in vessels having at least one closed tank for cargo, incorporating an inert gas biased pressure/vacuum valve, has been developed.

The present invention provides a system whereby a gas bias is applied to the vacuum outlet of a pressure differential device such as a pressure/vacuum valve, to reduce the tank underpressure at which the pressure/vacuum valve will open during normal transport conditions. Upon a cargo tank rupture, the gas bias is removed, to increase the vacuum (or negative pressure differential in the tank) that is required for the pressure/vacuum valve to open. This delay in the opening of the pressure/vacuum valve acts to inhibit and thus reduce the outflow of any fluid cargo from the tank.

Figure 1:
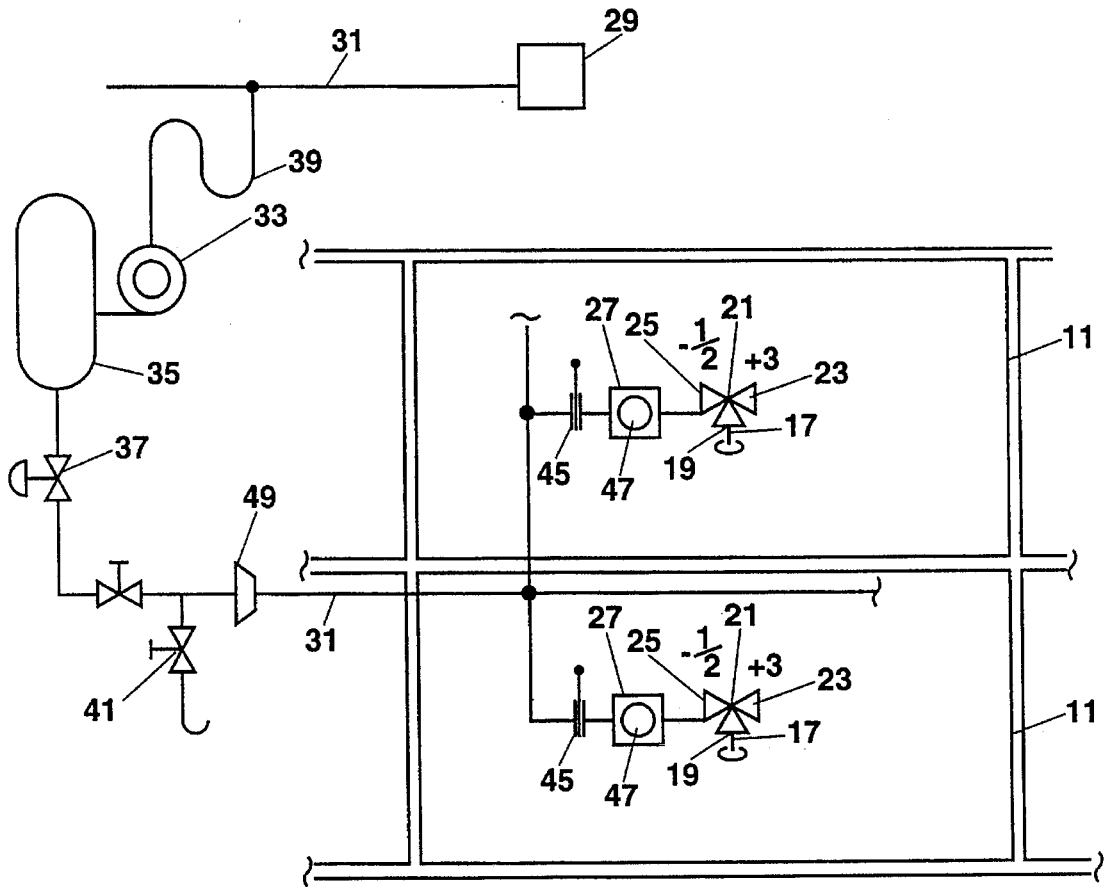
FIG. 1 shows a flowchart and a schematic representation of the inventive differential pressure relief system where both cargo tanks are intact.
Figure 4:
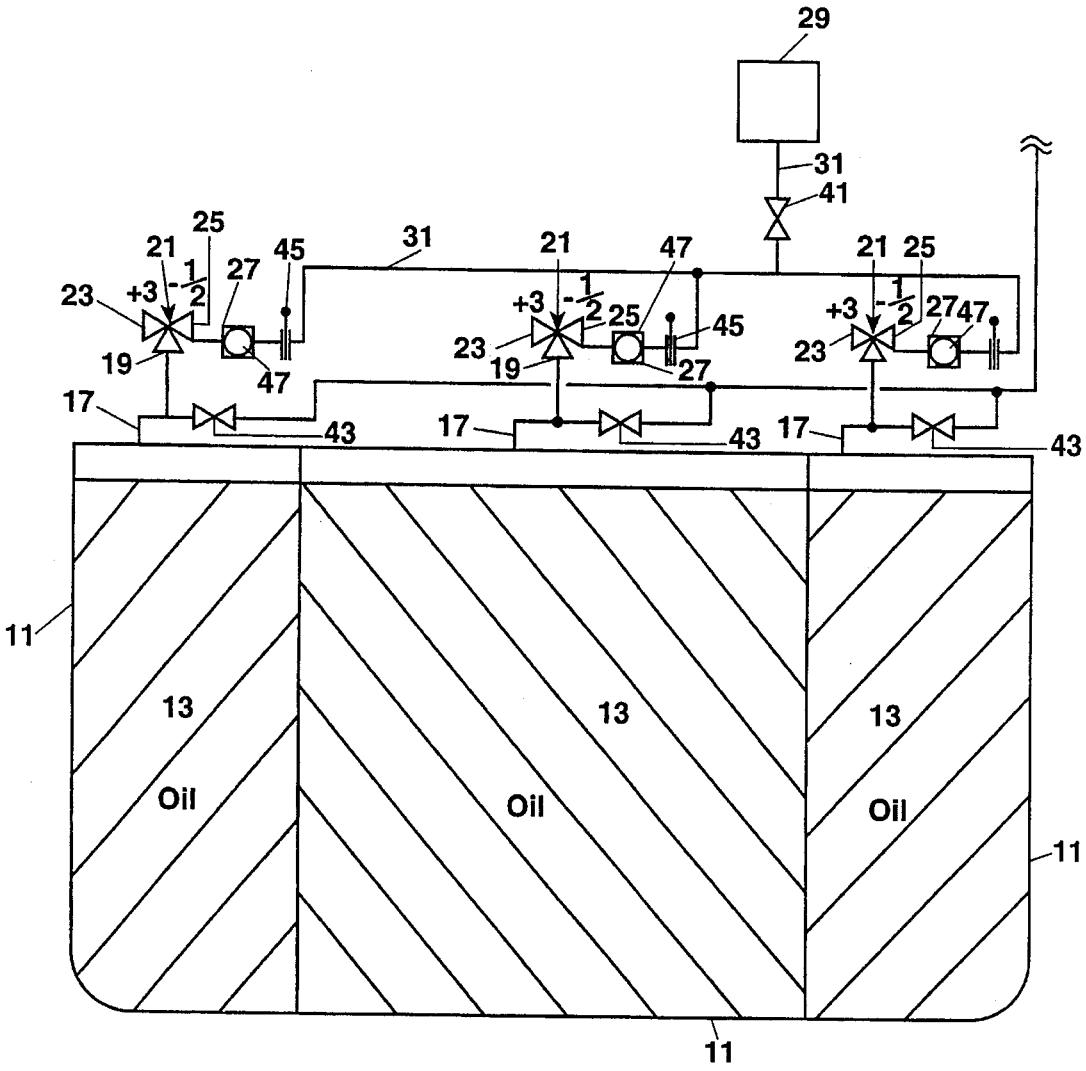
FIG. 4 is a schematic sectional view of the inventive system where both cargo tanks are intact.

Referring to the drawings, FIGS. 1 and 4 illustrate schematic representations of the present invention, for a case where all cargo tanks 11 are intact, and the vessel is operating at normal conditions. By normal conditions, we mean the situation where there is no evidence of a tank rupture or cargo spillage, aside from any minor gas leaks that would be considered typical. The tanks are closed cargo tanks for transporting fluid cargo 13 such as oil. Each of the tanks 11 has a hatch (not shown), and has a vent conduit. A distal end 19 of the vent conduit 17 connects the interior of the tank 11 with the atmosphere.

A differential pressure valve, such as a pressure/vacuum valve 21 is connected to the distal end 19 of the vent conduit 17. Pressure/vacuum valves 21 are known in the art, are common on vessels such as tankers, and any of several available models thereof would be acceptable, provided that the pressure/vacuum valve 21 has a pressure discharge outlet 23, a separate vacuum outlet 25, and separate valve seats (not shown). The valve seats are not shown in the drawings, as the position and function of valve seats in pressure/vacuum valves are well known in the industry. For example, the "Dictionary Of Scientific And Technical Terms, 4th edition" by McGraw-Hill, defines "valve seat" as > 'the circular metal ring on which the valve head of a poppet valve rests when closed'.

Figure 8:
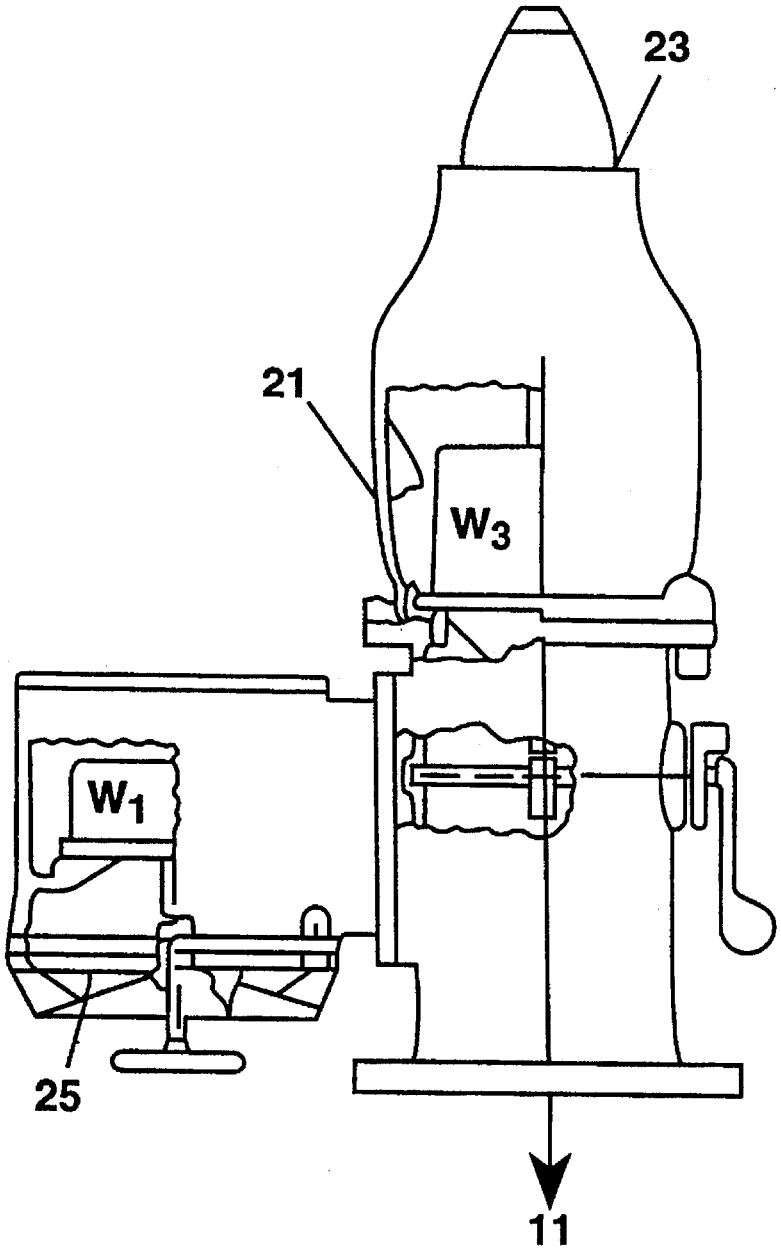
FIG. 8 is a schematic sectional view of a typical pressure vacuum valve available in the industry.
Figure 9:
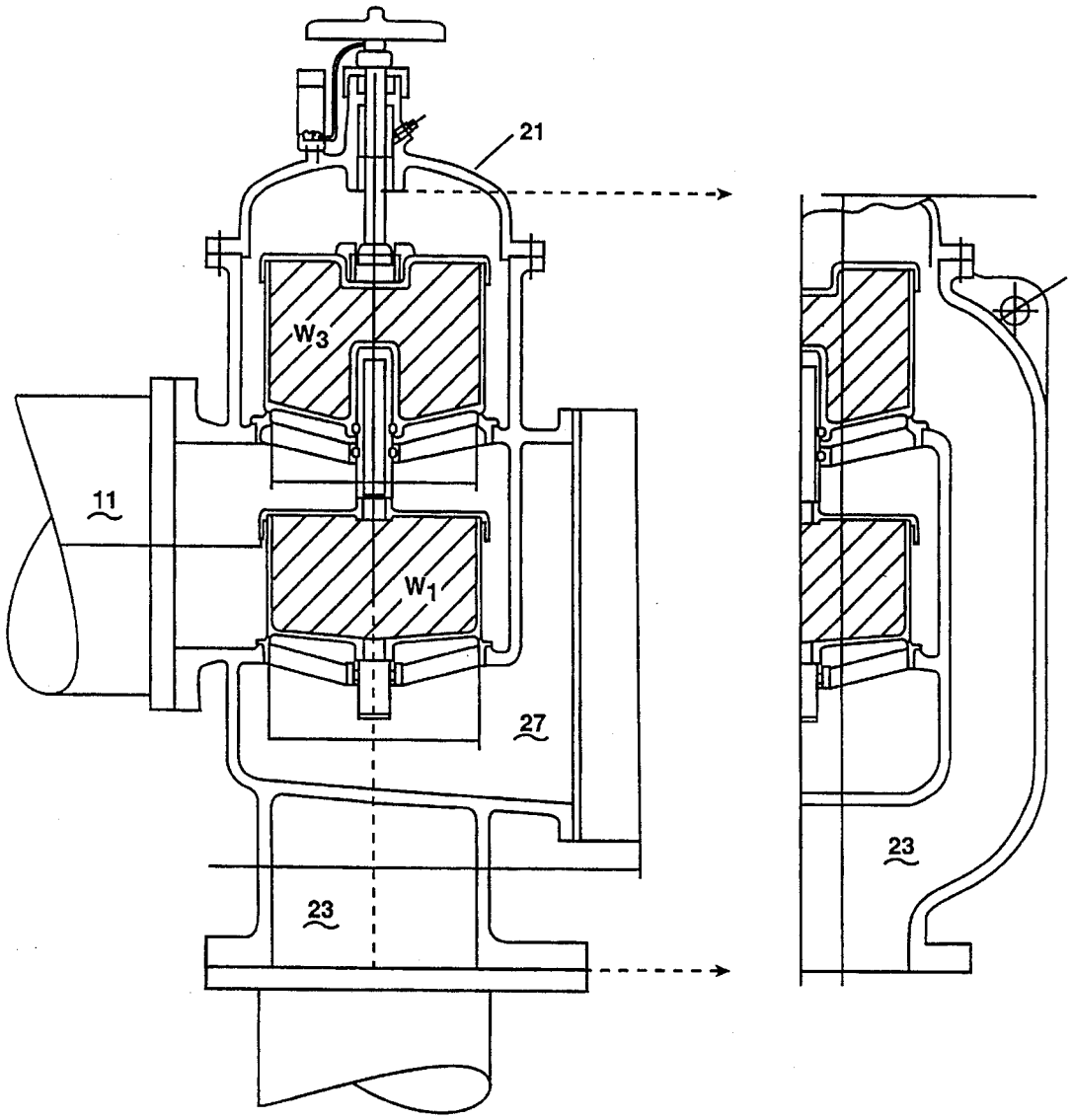
FIG. 9 is a schematic sectional view of an alternate type of pressure vacuum valve available in the industry.

FIGS. 8 and 9 illustrate two different types of pressure/vacuum valves available in the industry. Pressure/vacuum valves 21 are designed to open at a selected differential pressure across the valve seat, independently and individually for both the pressure discharge outlet 23 (resulting from a positive pressure differential between the tank 11 and atmosphere) and the vacuum outlet 25 (resulting from a negative pressure differential between the tank 11 and atmosphere). Therefore, the pressure/vacuum valves open when the differential pressure across either the pressure discharge outlet 23 or the vacuum outlet 25 exceeds that necessary to lift the weight acting against the valve seat to close off the opening. Normally, during the carriage of oil by ship, the valve 21 is set to open at a negative pressure differential of about −0.5 psig between the tank 11 and the vacuum outlet 25 or a positive pressure differential of about +3 psig between the pressure discharge outlet 23 and the tank 11. The present invention is concerned with applying a calculated bias to the vacuum outlet 25 portion of the pressure/vacuum valve 21, to facilitate the valve 21 opening at the relatively low negative pressure differential of approximately −0.5 psig.

A vacuum pump adaptor 27 has an adaptor conduit (not shown) which is connected to the vacuum outlet 25 of the pressure/vacuum valve 21. A vacuum pump (not shown) is connectable to the vacuum pump adaptor 27 such that a desired vacuum (typically about −7 psig) and a corresponding first desired pressure differential through said adaptor conduit and across said tank 11 can be maintained after tank damage has occurred. A portable and disconnectable vacuum pump permits selective use and minimizes the amount of additional piping needed on a ship deck. The pump ejects ullage space vapors through the vacuum outlet 25 of the pressure/vacuum valve 21. The vacuum pump could be used to ensure the negative pressure is not reduced due to small leakage into the ullage space from atmosphere thus minimizing the amount of cargo escaping the tank.

In the preferred embodiment, in order to ensure that the negative pressure of about −7 PSI is maintained and normal leakage reduces this pressure and thus allows more cargo to escape from the tank, the present invention allows for the vacuum pump to be connected to the cargo tank side of the pressure vacuum valve or cargo tank vapor/ullage space. This connection could be accomplished by means of a threaded connection or welded offsticker with threaded end. A quick connect/disconnect coupling of which several designs are readily available in the industry could be used to connect the vacuum pump hose or pipeline to the threaded connection.

It is desirable that the vacuum pump be air driven for use in non-gas-free locations. Vacuum pump capacity should be calculated and consideration should be given to system leaks. Vacuum pumps that satisfy the requirements of the present invention as well known in the art.

A source 29 of an inert gas has an inert gas bias conduit 31 which connects the source 29 to the vacuum pump adaptor 27 so that a pressure bias is applied to the vacuum outlet 25 so that the pressure/vacuum valve 21 will open at a second desired pressure differential between the tank and the atmosphere. Such an inert gas source 29 exists on most oil tankers and is well known in the art.

Therefore, the present system provides for two different pressure differentials between the tank 11 and the atmosphere whereby the pressure/vacuum valve 21 will open, resulting from two different replenishment gas sources (i.e. the atmosphere and the inert gas bias conduit 31). With replenishment gas of atmospheric pressure, the vacuum outlet 25 portion of the pressure/vacuum valve 21 is set such that the pressure/vacuum valve 21 will not open until the underpressure is equal to the second desired pressure differential (i.e. for the case of a damaged cargo tank). This second pressure differential must be calculated, but a value of −7 psig is hereby used as an example. For most pressure/vacuum valves, this pressure setting is accomplished by adding weight to the vacuum portion of the valve 21. Such a setting at −7 psig is in excess of existing pressure/vacuum valve 21 settings, where replenishment gas is provided at atmospheric pressure.

During normal carriage operations, it is desired that the vacuum outlet 25 portion of the pressure/vacuum valve 21 open at about −0.5 psig. Therefore, said pressure bias is added to the vacuum outlet 25 so that the pressure differential between the atmosphere and the pressure/vacuum valve 21 is −7 psig, but the pressure differential across the vacuum outlet 25 valve seat is only −0.5 psig. The addition of the pressure bias provides a total replenishment gas pressure of nominally 6.5 psig on the vacuum outlet 25. Now, the total differential pressure between the tank 11 and the atmosphere now is only −0.5 psig when the vacuum outlet 25 opens, since there is already a 6.5 psig pressure differential between vacuum outlet 25 and the atmosphere. This pressure bias is applied during normal operations (no damage to a cargo tank).

Once the pressure bias is removed (manually or automatically) the pressure/vacuum valve 21 will not open until a larger under pressure (here, about −7 psig) occurs within the tank 11 (i.e. during oil outflow from a ruptured tank). This increased available underpressure in a ruptured tank 11 will cause a reduced amount of oil 13 to leak from the tank 11. It is not practical to merely set the pressure/vacuum valve 21 to open at −0.5 psig, because the valve 21 would require re-setting as the vessel approached a port. There is a significant danger that an operator may forget to reset the valve 21, and during normal discharge from the tank 11, the tank 11 may collapse.

Generally, sources 29 of inert gas on tank ships typically provide varying pressures of about a few psig. As it has been established for at least this example, that a maintained pressure through the inert gas bias conduit 31 of 6.5 psig is required, a means for providing the inert gas to the vacuum outlet 25 at such desired pressure is necessary. Most situations will require an inert gas pressure of less than 10 psig. A continuous pressure on the vacuum outlet 25 of the pressure/vacuum valve 21 will effectively reverse any leakage across the valve 21 and will help keep the pressure in the tanks 11 at a desired level.

One effective means to provide the inert gas through the inert gas bias conduit 31 is to boost the pressure at the inert gas source 29 through the use of a compressor 33 down line. Compressors 33 are well known in the art, and can effectively connect the inert gas bias conduit pressure from a few psig to a maintained 6.5 psig.

In another embodiment of the invention, an inert gas accumulator 35 can store compressed inert gas to remove the requirement of a continuous inert gas supply source 29. Inert gas could be stored at various pressures, such as 100 psig. Such accumulators are well known in the art. An inert gas pressure reducer 37 is a useful means for reducing the compressed inert gas pressure to the desired level (here, 6.5 psig).

Gas pressure thus affects the operation of the pressure/vacuum relief valve, as line 31 is connected to a compressor and or an accumulator (pressure vessel), which supplies inert gas to a regulator which maintains a continuous 6.5 PSI on the underside of the pressure/vacuum valve seat. This pressure provides the bias which ensures that routine negative pressures (about −0.5 PSI) in the cargo tank are relieved, as the bias reduces effective weight of valve.

A system of valves, seals, and alarms is recommended to be emplaced in the inventive differential pressure relief system. A loop seal 39 can be positioned between the compressor 33 and the inert gas source 29, to insure isolation between the cargo tanks 11 and the machinery spaces. A bias line block and bleed valve 41 allows for manual removal of the inert gas bias pressure from the vacuum outlet 25. A low bias pressure alarm (not shown) can activate the bias line block and bleed valve 41, although it is desirable to also have a manual system if an impending grounding was recognized. In addition, the low bias pressure alarm can be arranged to prevent or stop operation of the ship's cargo pumps. Low pressure alarms (not shown) in both the inert gas bias conduit 31 and the inert gas source 29 are also desirable to alert the crew as to a need to change an accumulator 35 or repair the source 29.

In the preferred embodiment, a cargo tank offsticker shutoff valve 43 is installed on each conduit connected to the tanks 11, including the inert gas conduit (not shown) to isolate the tanks 11 from other sources of make up gas for the ullage space. These valves 43 are closed when the tanks 11 are filled when entering a danger zone. Otherwise, these offsticker valves 43 are open. In the preferred embodiment, once the offsticker valves are closed due to the tanker being laden in a danger zone, they remain closed until port state control is exercised. Manually operated shutoff valves 43 are the least costly means, and provide those port states (such as the U.S. Coast Guard) the ability to monitor if the present differential pressure relief system is being used properly.

In another embodiment of the invention, spectacle blind flanges 45 are positioned between the vacuum pump adapter 27 and the inert gas bias conduit 31, to isolate the vacuum pump adaptor of a damaged cargo tank 11 from the inert gas bias conduit 31. This allows bias pressure to be applied to remaining, undamaged tanks 11, thus resetting their respective vacuum outlet 25 to −0.5 psig (i.e. for normal conditions). Spectacle blind flanges 45 typically have one portion of the flange with a hole the same size as the inside bore of the conduit 31, whereas the other part of the flange has no hole, so that the flange prevents fluid passage through a conduit. By properly positioning the spectacle blind flanges, the inert gas bias conduit 31 is isolated from a vacuum pump adapter 27.

A rupture disk 47 is disconnectably connected to the vacuum pump adaptor 27, to seal off the adaptor conduit, such that the disk 47 will rupture at a third desired negative pressure differential, across the disk 47 to allow atmospheric pressure to reach the vacuum outlet 25, after which the rupture disk 47 is removed, and a vacuum pump (not shown) is substituted therefore, so that the first desired pressure differential between the tanks 11 and the atmosphere can be maintained. The rupture disk 47 is disconnectably connected to the vacuum pump adapter to seal off the adapter conduit and is thus part of the pump adaptor conduit. Therefore, the rupture disk seals the vacuum pump adapter, and effectively performs the same task as the walls of a conduit (i.e., providing a barrier between two areas of different pressure).

The rupture disk 47 is designed to fail if subjected to a relatively small negative pressure differential in the bias conduit 31, such as −0.25 psig (i.e. oil is flowing out of the tanks 11 causing the pressure/vacuum valve 21 to open to the vacuum outlet 25). When the disk 47 fails, bias pressure falls to atmospheric pressure, and the vacuum outlet 25 of the pressure/vacuum valve 21 is automatically reset to open at −7 psig. It is during this time that the pressure/vacuum valve 21 is set to the second desired differential pressure, that the inventive system greatly reduces the amount of fluid cargo from exiting through a rupture in the tank 11.

The rupture disk 47 is also designed to rupture at a larger, positive pressure originating from inside the bias conduit 31. For this example, a positive pressure differential of +8 psig was determined to be suitable, although one of ordinary skill in the art of cargo tank design could calculate such a positive pressure differential requirement. The rupture disk 47 must be of sufficient diameter to assure that atmospheric pressure in the bias conduit 31 is maintained after disk failure, and to accommodate the vacuum pump on the same mounting on the vacuum pump adaptor 27. A stainless steel rupture disk is particularly useful. A mask (not shown) placed on the side of the rupture disk 47 furthest from the bias conduit 31 enables the disk 47 to be ruptured at differing absolute negative and positive pressure differentials. The required burst pressure on each direction across the rupture disk is a function of the diameter of that portion of the disk surface not masked.

$$\text{burst pressure}=f(1/\text{disk diameter})$$

Therefore, the outlet side of the rupture disk 47 (furthest from the bias conduit 31) has a smaller effective diameter, so that a greater positive pressure can be applied from the bias conduit 31 without disk failure.

To further illustrate how the rupture disk can connect the valve to the atmosphere, it is known that if cargo tank integrity is damaged and cargo tank liquid levels are above the level of the sea outside the vessel, then larger under pressures in the cargo tank would occur due to cargo outflow (about −7 PSI). As a result, this larger under pressure would cause the pressure/vacuum valve to lift, which would cause the rupture disk 47 fitted on the offsticker spool piece to rupture. This would release the inert gas pressure in line 31 to the atmosphere and would remove the bias pressure from the vacuum valve seat. The pressure/vacuum valve would immediately be biased by the atmospheric pressure and its relative weight would immediately increase, and the pressure/vacuum valve would close, holding about a −7 psi negative pressure in the cargo tank. This negative pressure would significantly reduce the out flow of cargo from the tank.

With respect to connecting line 31 to valve 21, line 31 could be connected by at least two means known in the art to the negative pressure or vacuum side of the pressure vacuum relief valve 21. One means would be to fabricate (for example) a schedule 80 pipe spool piece (known in the art) with conventional welded flange end connections at either end and a flanged offsticker. The rupture disk 47 could be bolted to the offsticker flange end. One end of the spool piece could be connected to the pressure vacuum valve on the suction valve side and a blank flange fitted with a NPT threaded hole to connect line 31 connected to the opposite end.

In yet another embodiment of the invention, a flow control orifice 49 is positioned across the inert gas bias conduit 31, at a location between the pressure/vacuum valve 21 and the pressure reducer 37 so that the flow of the inert gas therethrough is restricted. By removing the bias pressure from the vacuum outlet 25, the pressure/vacuum valve 21 will not open until a larger under pressure occurs within a tank 11. It is desirable to require this larger underpressure (said second desired pressure differential) at a time of oil outflow. As oil flows out, the underpressure in the tank 11 will reduce to the level where it will cause the vacuum outlet 25 side of the pressure/vacuum valve 21 to open (in this example, at −0.5 psig). With the flow control orifice 49 correctly sized, pressure in the inert gas bias conduit 31 must drop, due to Boyle's Law which is:

$$P \times V/T = K$$

as flow velocity across the orifice 47 reaches the speed of sound, and choke conditions are established, limiting the amount of gas that can enter the bias conduit. Therefore, as oil 13 flows out through a hole in the tank 11, tank pressure falls which will open the vacuum outlet 25 side of the pressure/vacuum valve 21, which was set at about −0.5 psig. This creates a large demand for replenishment gas in the tank 11, causing a large pressure differential across the flow control orifice 49 creating choke flow conditions. Now, no additional gas can flow through the orifice 49, so the pressure in the inert gas bias conduit 31 is reduced, causing the rupture disk to open, thereby automatically resetting the pressure/vacuum valve opening point to the desired lower level, about −7 psig in this example.

Figure 10:
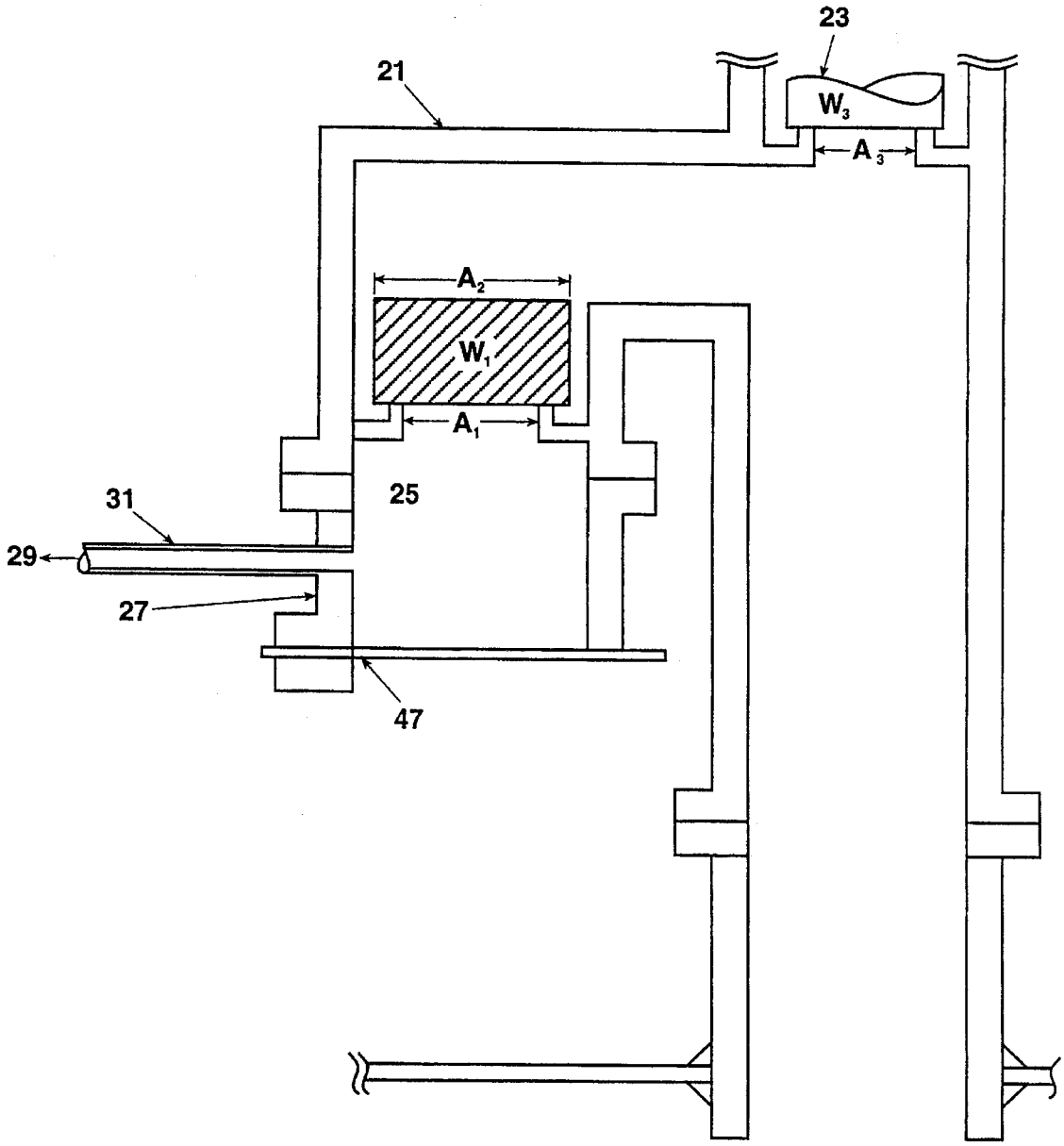
FIG. 10 is a a schematic sectional view of a pressure vacuum valve modified for use in the preferred embodiment of the invention.

FIG. 10 which is a simplified representation of the pressure/vacuum valve 21 shown on FIG. 8, illustrates the modifications which are made to a commercially available pressure/vacuum valve 21 for such valve to operate as part of preferred embodiment of the present invention.

Vacuum pump adaptor 27 is added to the vacuum outlet 25 of the pressure/vacuum valve 21. An inert gas bias conduit 31 is connected to the vacuum pump adaptor 27 so that a pressure bias source 29 can be applied to the vacuum outlet 25. A rupture disc 47 is disconnectably attached to the vacuum pump adaptor 27. This rupture disc 47 is set to fail at a relatively small negative pressure in the bias conduit 31.

It should be noted that the pressure discharge outlet 23 is not involved with the operation of the present invention, in the embodiment shown in FIG. 10.

The operation of the pressure/vacuum valve 21 when used as part of the present invention is based on the following theory, with reference to FIG. 10.

The force to open the vacuum side of pressure/vacuum valve, (i.e. lift W1) can be expressed as:

$$F1=A1\times P29$$

Force keeping the vacuum side of pressure/vacuum valve closed can be expressed as:

$$F2=W1+P11\times A2$$

The vacuum side of pressure/vacuum valve opens when F1 is slightly greater than F2. If it is assumed for purposes of this example that the vacuum side opens when these forces are equal, the mathematical solution for tank pressure P11 for both normal and tank damaged cases can be expressed as:

| Normal operations | Tank Damaged (P29 = 0) |
|---|---|
| P11 = (A1 × P29 − W1)/A2 | P11 = −W1/A2 |

The above calculations show that the cargo tank 11 pressure during normal operations will be higher (less vacuum since all pressures are gage) by an amount of A1×P29/A2 when they are open to the vacuum outlet 25, than after tank damage, if the present invention is operational. Since A1 and A2 are almost identical, the difference in the pressure is essentially equal to P29 (the pressure of the inert gas source 29).

Figure 7:
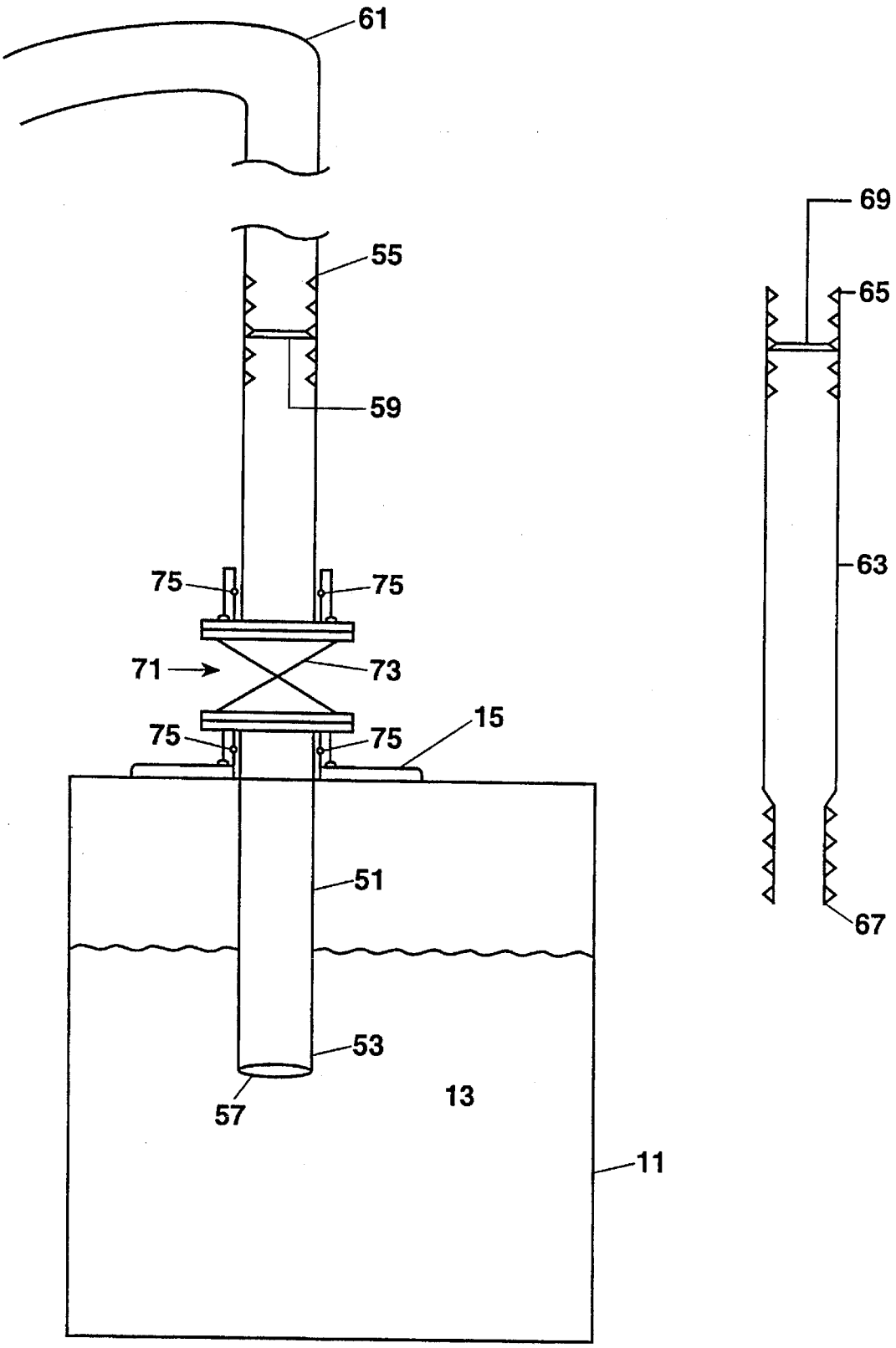
FIG. 7 is a schematic sectional view of the pump discharge conduits and a modified Butterworth cover plate.

In another embodiment of the invention, as shown in FIG. 7, a first pump discharge conduit 51 has a lower end 53 and an upper end 55. The lower end 53 is disconnectably connected to a pump 57. The upper end 55 has a puncturable diaphragm 59 disposed across the discharge conduit 51 and having a small hole (not shown) as to reduce any buoyancy effects. The hatch 15 is adapted to permit the first pump discharge conduit 51 to slide therethrough into the tank 11 to a selected level to permit removal of a desired volume of the cargo 13 to be removed, while maintaining the currently existing pressure differential between the atmosphere and the tank 11. Aluminum is especially useful to construct the discharge conduit 51 due to its light weight. A portable pump 57 is desirable. It is desired to provide holes in the upper end 55 to enable a bar (not shown) to fit therethrough to prevent the discharge conduit 51 from slipping into the tank 11. In the event of an oil leak, the pump 57 can pump a desired volume of oil 13 up through the discharge conduit 51, and into a storage conduit 61.

In another embodiment, the upper end 55 of the first discharge conduit 51 has internal threads. At least one, second pump discharge conduit 63 has a top end 65 and a bottom end 67. The bottom end 67 is tapered and has external threads which connect with the internal threads of the upper end 55 of the first pump discharge conduit 51.

The bottom end 67 is sharp enough to be able to puncture the diaphragm 59 upon connection. The top end 65 has internal threads identical to those of the upper end 55, and has a second diaphragm 69 disposed across the top end 65 which is nearly identical to the first diaphragm 59. In operation, the second pump discharge conduit 63 is connected to the first pump discharge conduit 51 to enable a greater amount of cargo 13 to be removed from the tank 11. There is no need to pump all the cargo (oil) 13 out of a tank 11. Once a hydrostatic balance is reached, the tank 11 can be opened and conventional emergency pumping methods can be utilized.

In the preferred embodiment, the hatch 15 is a modified Butterworth cover plate 71. The modified Butterworth plate 71 has a ball valve 73 and one or more O-ring seals 75, all sized to permit the first and second pump discharge conduits, 51 and 63 to slide therethrough while maintaining the existing pressure differential.

FIGS. 1 and 4 illustrate the inventive differential pressure relief system with valves, cargo levels, and bias pressure set for normal operating conditions, during transport with intact tanks. The vacuum outlet 25 portion of the pressure/vacuum valve 21 is set at −0.5 psig for both tanks, and shut off valves 43 are open.

Figure 2:
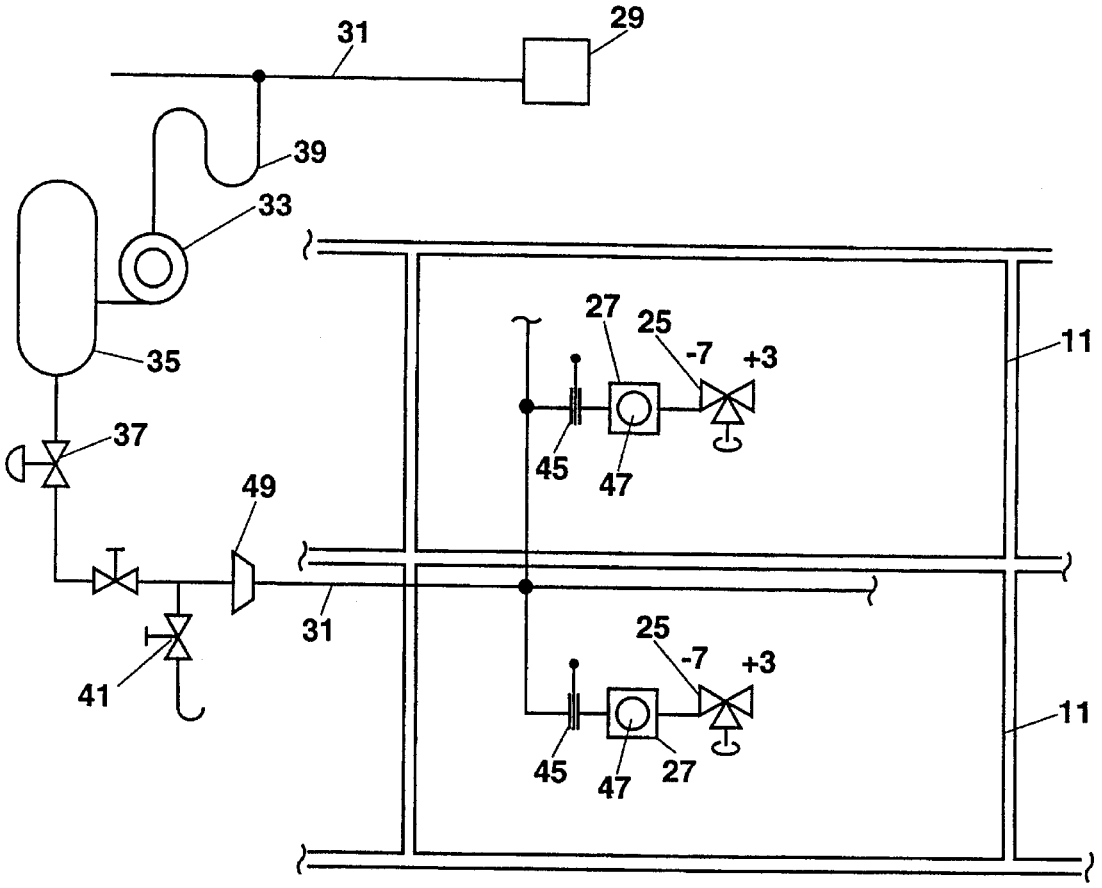
FIG. 2 shows a flowchart and a schematic representation of the inventive differential pressure relief system where one cargo tank has been damaged but prior to defining the extent of damage.
Figure 5:
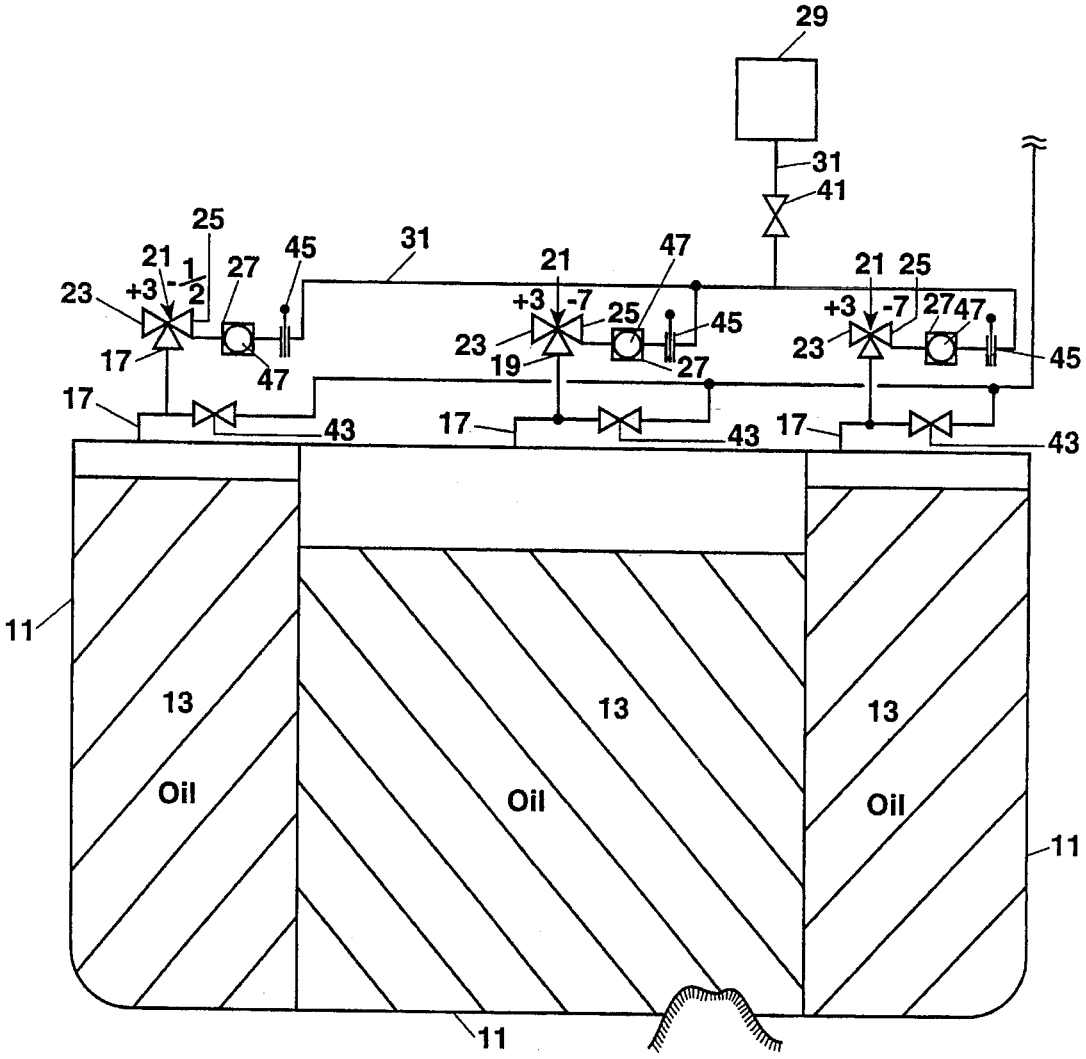
FIG. 5 is a schematic sectional view of the inventive system where one cargo tank has been damaged but prior to isolation of the damage.

FIGS. 2 and 5 illustrate the case where a tank 11 has been ruptured but the damage has not yet been isolated. The rupture disk 47 has failed, the bias pressure has fallen to atmospheric, and now the vacuum outlet 25 of the pressure vacuum valve 21 for all the tanks has been automatically reset to open at about −7 psig. The shut off valves 43 are closed. Oil out-flow is greatly reduced, due to the negative pressure differential in the tanks 11.

Figure 3:
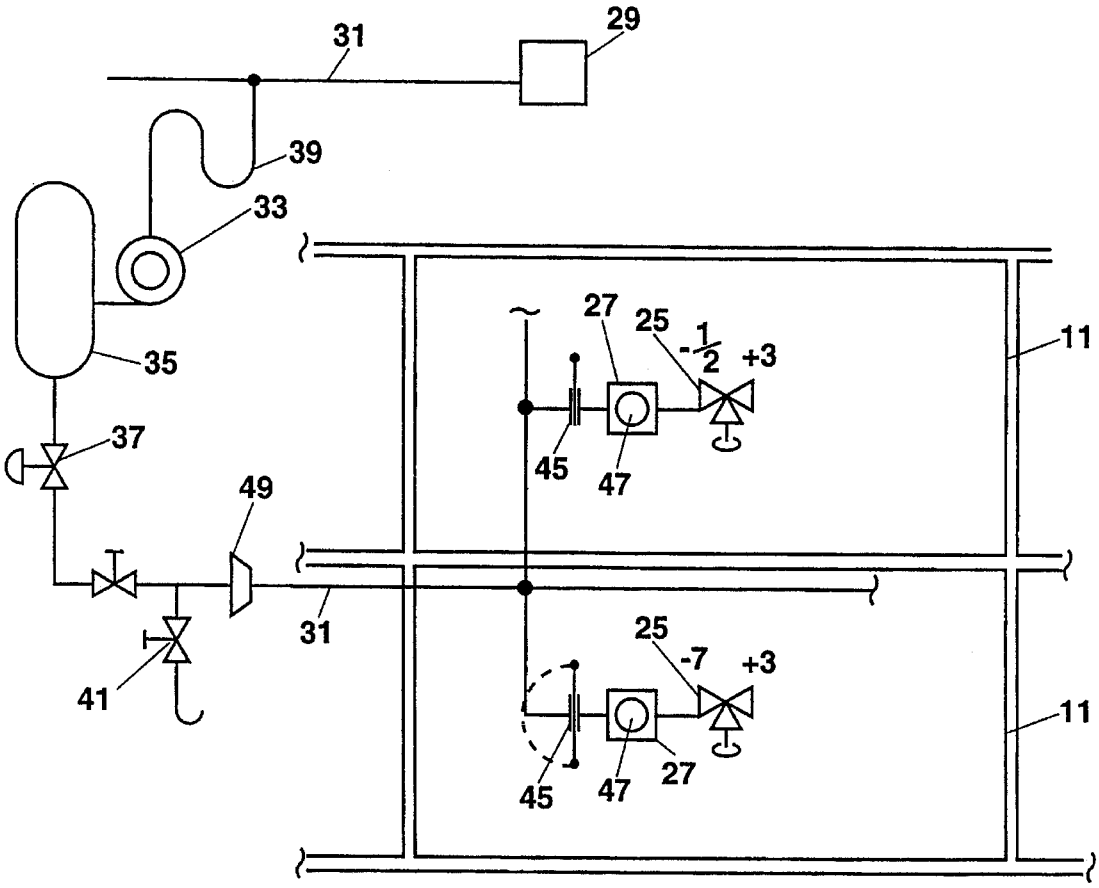
FIG. 3 shows a flowchart and a schematic representation of the inventive differential pressure relief system after isolation of the damaged cargo tank.
Figure 6:
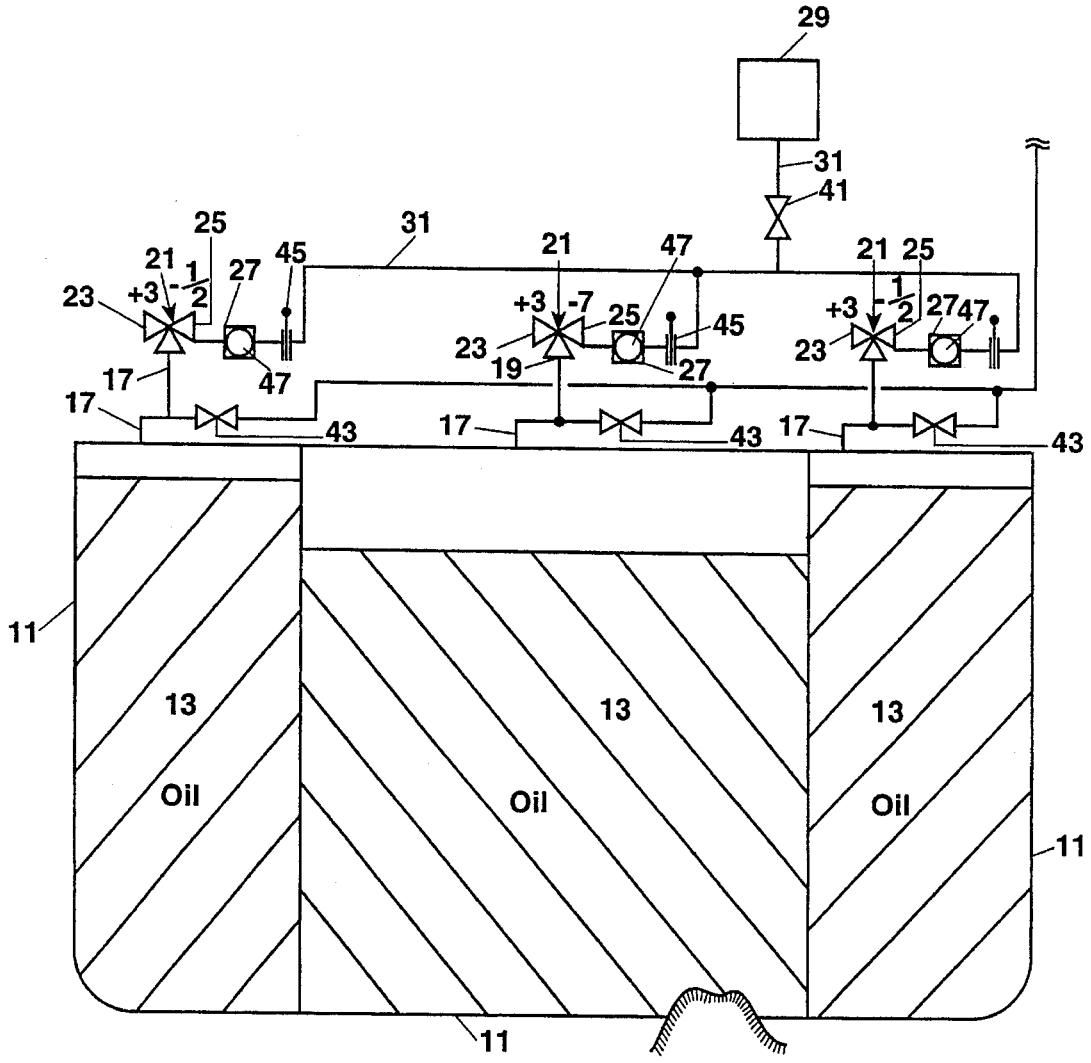
FIG. 6 is a schematic sectional view of the inventive system after isolation of the damaged cargo tank.

FIGS. 3 and 6 illustrate the case where a tank 11 has been ruptured and isolated. Only the shut off valve for the damaged tank is closed. The vacuum outlets 25 for the pressure/vacuum valves 21 for the intact tanks have been automatically reset to −0.5 psig, while the vacuum outlet 25 for the damaged tank remains set at −7 psig.

The present invention is relatively simple and inexpensive. There is no welding necessary to install the components on a tanker. By monitoring the inert gas bias pressure, ship safety can be assured. The system allows for preventive measures to be taken when entering areas where grounding is possible. By automatically maintaining a suitable negative pressure differential in a damaged tank, cargo outflow can be greatly contained. The system can be verified by port states, by checking the condition of the offsticker valves 43 and the bias pressure.

While a preferred embodiment of the invention has been described and illustrated, it should be apparent that many modifications can be made thereto without departing from the spirit or scope of the invention. Accordingly, the invention is not limited by the foregoing description, but is only limited by the scope of the claims appended hereto.

What is claimed is:

1. A differential pressure relief system for use in vessels having at least one closed tank for cargo, said tank having a hatch, and a vent conduit having a distal end connecting said tank with the atmosphere at said distal end, said system providing automatic differential pressure relief comprising:

(a) a pressure/vacuum valve connected to said distal end of said vent conduit, said pressure/vacuum valve having a pressure discharge outlet, a separate vacuum outlet, and separate valve seats;

(b) a vacuum pump adaptor having an adaptor conduit connected to said vacuum outlet of said pressure/vacuum valve;

(c) a vacuum pump connectable to said vacuum pump adaptor such that said vacuum pump can maintain a first desired pressure differential through said adaptor conduit and across said tank;

(d) a source of inert gas having an inert gas bias conduit connecting said source to said vacuum pump adaptor to provide a pressure bias to said vacuum outlet so that said pressure/vacuum valve will open at a second desired pressure differential between the tank and the atmosphere;

(e) means for providing said inert gas from said source to said vacuum outlet at a desired pressure;

(f) means for providing said inert gas from said source to said vacuum outlet at a desired flow rate; and (g) a rupture disk disconnectably connected to said vacuum pump adaptor to seal off said adaptor conduit, such that said disk will rupture at a third desired pressure differential across said disk to allow atmospheric pressure to reach said vacuum outlet, after which said rupture disk is removed and said vacuum pump substituted therefor, so that said first desired pressure differential through said adaptor conduit and across said pressure/vacuum valve can be maintained.

2. The differential pressure relief system of claim 1 further comprising a spectacle blind flange positioned between said vacuum pump adaptor and said inert gas bias conduit to selectively isolate said vacuum pump adaptor outlet from said inert gas bias conduit.

3. The differential relief system of claim 1 further comprising a first pump discharge conduit having a lower end and an upper end, said lower end disconnectably connected to a pump, said upper end having a puncturable diaphragm, said diaphragm disposed across said upper end and having a hole of such small size as to reduce any buoyancy effects, and said hatch adaptable to permit said first pump discharge conduit to slide therethrough into said tank to a selected level to permit removal of a desired volume of said cargo from said tank, while maintaining the existing pressure differential between the atmosphere and said tank.

4. The differential pressure relief system of claim 3 wherein said hatch comprises a Butterworth plate, said plate further comprising a ball valve and one or more O-ring seals, said ball valve sized to permit said first pump discharge conduit to slide therethrough while maintaining said existing pressure differential.

5. The differential pressure relief system of claim 3 wherein said upper end has internal threads, said system further comprising at least one, second pump discharge conduit having a top end and a bottom end, said bottom end having external threads which are connectable to said internal threads of said upper end of said first pump discharge conduit and said bottom end able to puncture said diaphragm upon connection to said upper end, said top end having second internal threads identical to said internal threads and a second diaphragm having the same characteristics as said diaphragm, and a means for providing support to said first pump discharge conduit in its lowered position, so that said second pump discharge conduit can be connected to said first pump discharge conduit to permit an increased amount of cargo to be removed.

* * * * *